US005662094A

United States Patent [19]

Giacomelli

[11] Patent Number: 5,662,094

[45] Date of Patent: Sep. 2, 1997

[54] GUILLOTINE CUTTING APPARATUS FOR BRICKS, BUILDING BLOCKS AND THE LIKE

[76] Inventor: Angelo J. Giacomelli, 7335 Dickenson Road East, Mount Hope, Ontario, Canada, L0R 1WO

[21] Appl. No.: 675,112

[22] Filed: Jul. 3, 1996

[51] Int. Cl.[6] ..... B28D 1/32

[52] U.S. Cl. ..... 125/23.01; 125/40; 83/468

[58] Field of Search ..... 125/23.01, 23.02, 125/40; 83/468, 468.7, 268, 247

[56] References Cited

U.S. PATENT DOCUMENTS

| | | | |
|---|---|---|---|
| 2,874,688 | 2/1959 | Bieanz et al. | 125/23.01 |
| 3,297,015 | 1/1967 | Crawford | 125/23.01 |
| 3,886,927 | 6/1975 | Chattin | 125/23.01 |
| 3,978,842 | 9/1976 | Coffman | 125/23.01 |
| 4,696,213 | 9/1987 | Conneally | 83/468 |
| 5,169,045 | 12/1992 | Liu | 25/23.02 |
| 5,507,678 | 4/1996 | Waggoner et al. | 125/23.01 |

*Primary Examiner*—Robert A. Rose
*Assistant Examiner*—George Nguyen
*Attorney, Agent, or Firm*—McConnell and Fox

[57] ABSTRACT

A guillotine cutting apparatus for solid bodies of hard brittle materials such as building bricks, blocks and stone, has a base member mounting a movable cutter for engagement with the body and cutting force applying means which imparts an impact cutting force to the cutter. Preferably a measuring frame for determining the length of the body parts that are to be cut comprises a movable stop member against which one end of the body is butted, the stop member being resiliently mounted in the frame to permit its movement away from the cutting plane as the body is cut. Preferably the cutting force applying means comprise a hand operated hammer slidably mounted on a relatively long shaft connected to the cutter member and guided by the shaft into contact with an anvil on the shaft, thereby imparting a stored energy high impact cutting force to the movable cutter. Preferably also a body receiving member to one side of the cutting plane is resiliently mounted for vertical movement and permits downward movement of the cut part of the body toward the base member as it is cut under the action of the cutting force. Preferably further a second cutter member in the same cutting plane engages the bottom surface of the body for simultaneous cutting engagement with the body.

20 Claims, 3 Drawing Sheets

GUILLOTINE CUTTING APPARATUS FOR BRICKS, BUILDING BLOCKS AND THE LIKE

FIELD OF THE INVENTION

This invention is concerned with improvements in or relating to guillotine cutting apparatus for solid bodies, and especially but not exclusively with such apparatus for cutting rectangular shaped bodies of relatively brittle materials, such as bricks, blocks and construction stone.

DISCUSSION OF BACKGROUND MATERIAL

Bricks, building blocks, natural and artificial stone are examples only of strong, rigid relatively brittle materials, that are used in construction, and are commonly and extensively used, owing to their economy, versatility and decorative possibilities. The hand laying of these materials is labour intensive, requiring considerable skill and experience to ensure that the resulting structures are mechanically sound, of good appearance, and yet have been produced economically. Stone must often be trimmed at the site, while a time-consuming part of brick and block laying arises at wall corners and door and window openings, where it is often found that partial-length bricks or blocks are required. Owing to manufacturing tolerances in brick or block length, and variations in thickness of the intervening mortar, it usually is not possible to determine beforehand what partial length is required, and this must be measured in situ and cut from the bricks or blocks just before use. There are a number of well established ways in which such cutting has been achieved hitherto.

Perhaps the oldest method employs a special hammer with which the mason scores the brick, block or stone until it breaks along the score line. This requires considerable skill and experience on the part of the mason if a clean, accurate cut is to be obtained, and even with a skilled operative it is very difficult to obtain such a cut, owing to the random brittle structure common to the materials, so that a number of attempts may be required with corresponding waste of time and material. Moreover, it is difficult to obtain a smooth cut, and virtually impossible to obtain thin pieces, owing to the high probability that they will be shattered by the hammer blows.

One type of cutting apparatus specifically designed for this purpose and in common use is a guillotine, in which a cutting blade is forced down on to the body by a motor consisting of a hand-pumped hydraulic cylinder and piston. It requires the cutting location to be marked on the brick or block before insertion into the machine, and is time-consuming because of the slow action of such a pump, and the need to release the pressure and retract the piston to raise the blade when the cut is completed. The apparatus is found to be somewhat uneconomic when used with bricks provided with vertical mortar-receiving keying holes, since as the blade is pressed home the brick tends to break at the holes and not at the intended cut line, so that a number of attempts may be required with a relatively large wastage of time and material. The apparatus is relatively heavy and expensive and is difficult to lift onto and to operate on scaffolding, where the majority of the work usually is done. Motor operation of the pump makes it even heavier and more expensive. If electricity is not readily available at the site then a gasoline-powered generator must also be provided. In another version of such apparatus the cutting blade is forced down on to the body by motor means comprising a lever multiplying the steady cutting force applied by hand by the operator. However, owing to the high compression strengths of these materials, the high cutting force required necessitates very strong and heavy lever structures.

Another apparatus in commercial use is a rotary cutting saw designed specifically for cutting hard, brittle materials and employing an expensive diamond coated blade. These are also heavy and expensive and produce considerable amounts of fine dust so that the operatives need to wear dust masks and the surroundings tend to be coated with the dust. The wastage when used with holed bricks is much less than with the hydraulic or lever operated apparatus, but of necessity they are electric motor driven, with the consequent problem if suitable electric power is not available. They have the added problem that the brick or block must be clamped, or held firmly by hand by the operative, while in frictional contact with the fast moving blade, slowing down its operation or making it more tiring to operate.

DEFINITION OF THE INVENTION

It is the principal object of the present invention to provide a new guillotine cutting apparatus for hard, brittle materials that is relatively light and inexpensive in construction.

It is another object to provide such apparatus that is particularly suitable for Use in cutting bricks, building blocks and construction stone close to the work site, even when on scaffolding or in other difficult work locations.

It is another object to provide such apparatus with which the power for the cutting is readily provided by the operator.

It is a further object to provide such apparatus that enables rapid, accurate, repeated, cuts to be made simply and effectively.

It is a further object to provide such apparatus that enables smooth surfaced, accurate cuts to be made and relatively thin lengths to be cut from larger bodies of hard brittle materials.

In accordance with the invention there is provided guillotine cutting apparatus for solid bodies having top, bottom, side and end surfaces, the apparatus comprising:

a base member upon which a body to be cut is placed with its bottom surface on a top surface of the base member;

cutter mounting means extending above the base member top surface and mounting a movable cutter member for movement toward and away from the base member top surface in a cutting plane;

a movable cutter member mounted by the cutter mounting means for said movement in the cutting plane, the member having a cutting edge engagable with the top surface of a body when placed on the base member top surface; and cutting force applying means operatively connected with the movable cutter member to impart a cutting force thereto to cut the body.

Such apparatus may comprise a body measuring means having a stop member movably mounted thereby, against which stop member the respective end surface of a body to be cut is butted;

the body measuring means being disposed above the base member top surface and mounted for movement toward and away from the cutting plane to change the relative lengths of the parts into which the body is cut;

the body measuring means and the stop member having resilient means between them permitting movement of the stop member and of the respective cut portion of the body away from the cutting plane as the movable cutter member cuts the body.

In such apparatus the cutting force applying means may comprise a shaft attached to and extending from the movable cutter member in the cutting plane, an anvil member on the shaft, and a hammer member mounted on the shaft for movement thereon by an operative toward and away from the anvil member, the hammer member being guided by the shaft for impact with the anvil member to impart a stored energy impact cutting force to the movable cutter member.

Such apparatus may instead or in addition comprise a second cutter member mounted by the base member and having a cutting edge disposed in the cutting plane engagable with the bottom surface of a body to be cut when placed on the base member top surface;

whereby the cutting force applied to the movable cutter member forces the body into simultaneous cutting engagement with the cutting edge of the second cutter member.

Such apparatus may instead or in addition comprise:

a body receiving member disposed to one side of the cutting plane and having top and bottom surfaces, the member being disposed above and spaced from the base member and receiving on its top surface a respective portion of a body to be cut; and resilient mounting means mounting the body receiving member on the base member and permitting corresponding movement of the body receiving member and the respective cut portion of the body toward the base member as the movable cutter member cuts the body.

DESCRIPTION OF THE DRAWINGS

A guillotine cutting apparatus which is a particular preferred embodiment of the invention will now be described, by way of example, with reference to the accompanying diagrammatic drawings, wherein.

DESCRIPTION OF THE PREFERRED EMBODIMENTS

Figure 1:
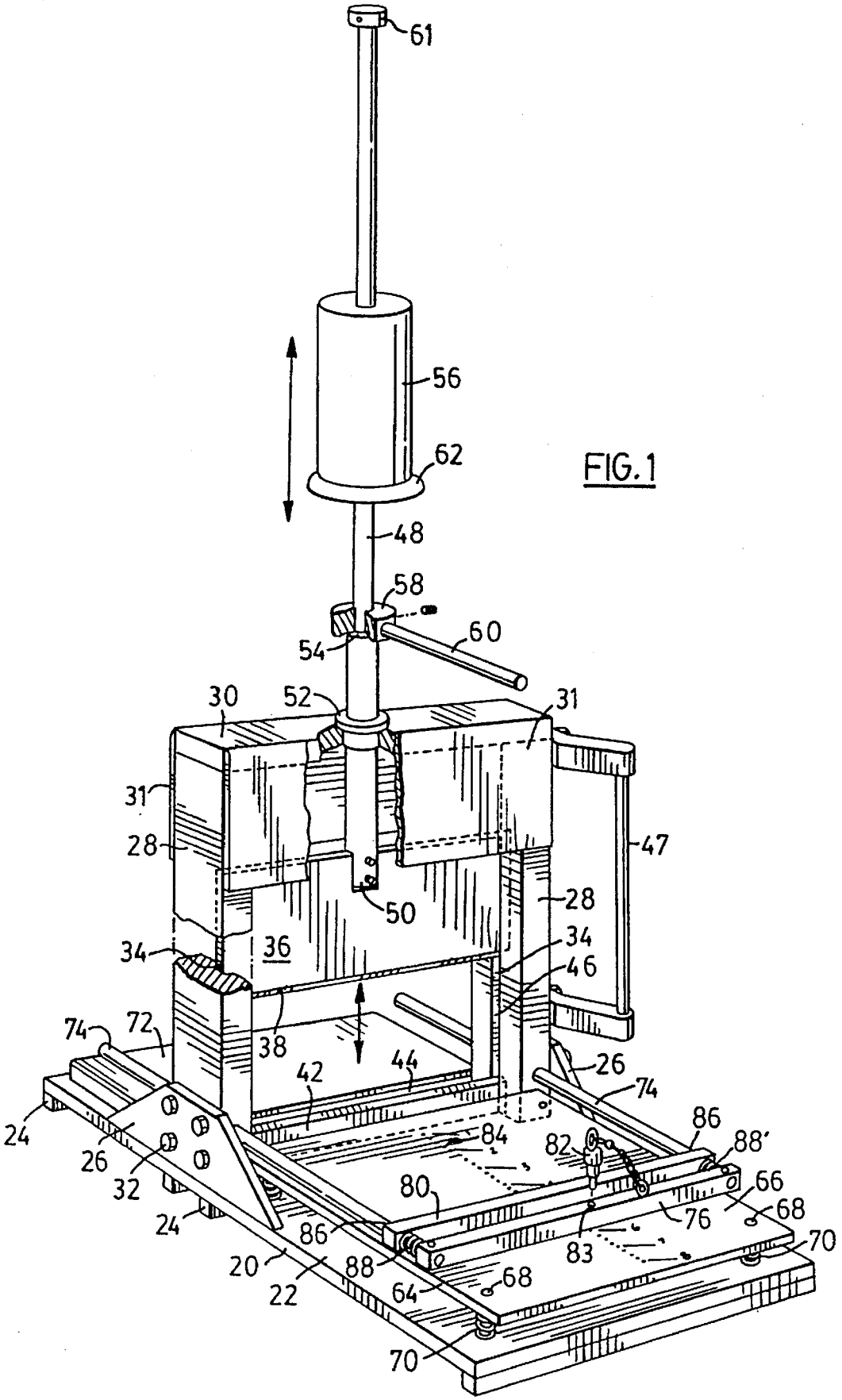
FIG. 1 is a perspective view from one corner and above, parts being shown broken away where necessary for better illustration.
Figure 2:
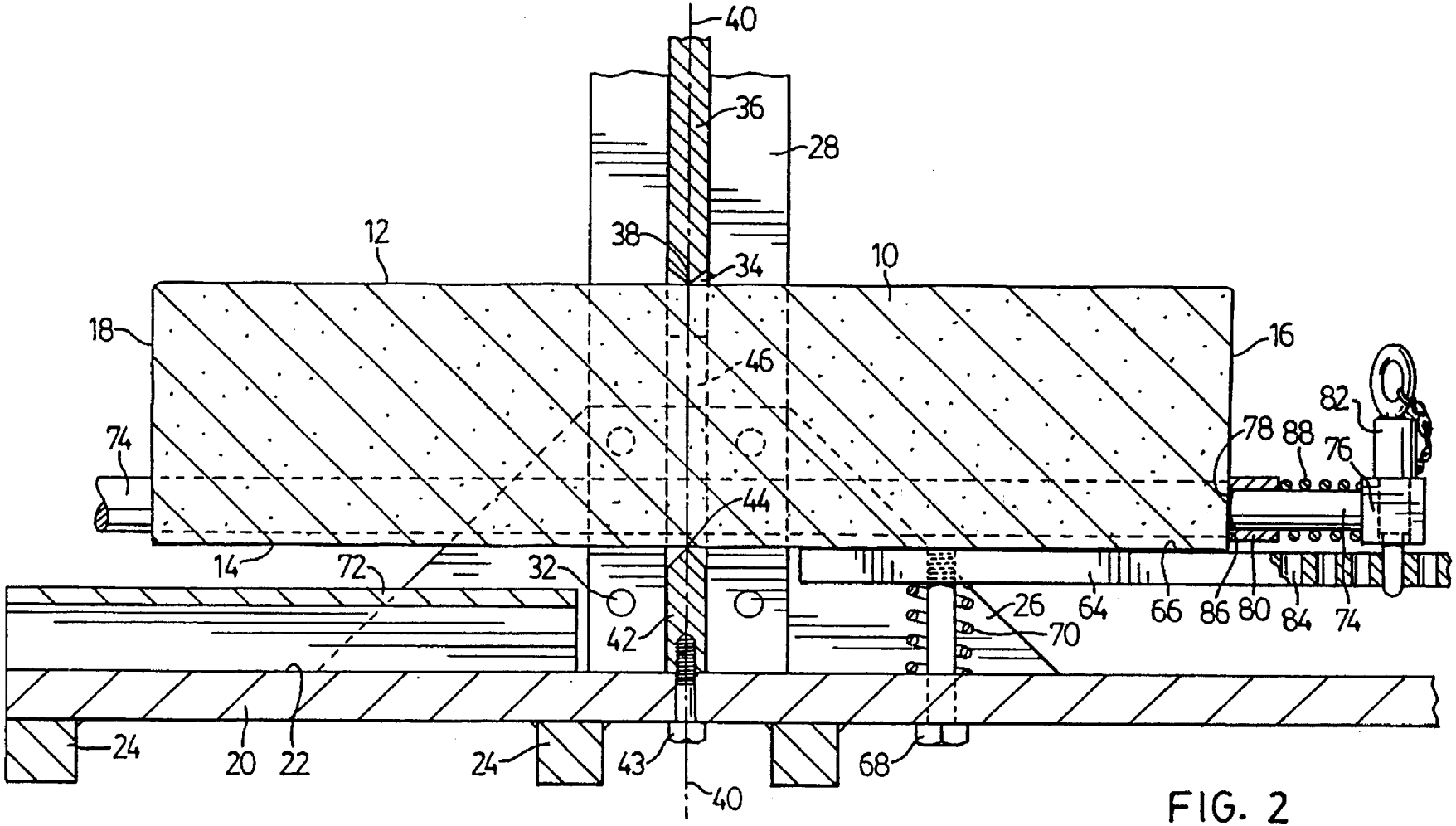
FIGS. 2 and 3 are similar part longitudinal cross-sections through the lower part of the apparatus showing respectively a brick in place ready to be cut and the two parts of the cut brick immediately after the cutting operation.

For convenience in description and illustration the solid body to be cut is shown (FIGS. 2 and 3) as a rectangular building brick 10 of standard dimensions about 21 cm (8.25 ins) long, about 10 cm (4 ins) wide, and about 6 cm (2.4 ins) thick. However, as will be apparent from the description which follows, the apparatus of the invention is equally usable for the cutting of solid bodies of other than rectangular shape, and particularly solid bodies of strong, rigid materials which have high compressive strength, but which are somewhat brittle, such as such as decorative bricks of various shapes, building blocks of concrete and mixtures using concrete as a binder, tiles, and construction stone, such as slabs of limestone and granite. For convenience in description, and in the language used in the claims, the body is designated as having top and bottom surfaces 12 and 14 respectively, and end surfaces 16 and 18. The use of the apparatus of the invention in the cutting of other, less uniform, shapes will readily be apparent.

The apparatus comprises a base member 20 having a flat rectangular top surface 22 and a plurality of spaced downward-extending feet 24 on which it stands. Two upstanding trunnions 26 are attached to the base member longer edges, as by welding thereto, and support thereon cutter mounting means consisting of a vertically extending inverted U-shaped frame comprising two parallel vertical pillars 28 of solid rectangular transverse cross-section, a solid connecting crossbar 30, and welded-on rectangular connecting side plates 31. The mounting means is removably attached to the trunnions by machine screws 32. The parallel facing surfaces of the legs 28 are provided with respective rectangular cross-section grooves 34 in which a movable cutter member 36 is mounted for vertical sliding movement toward and away from the base member top surface 22, the cutter member having a downward facing cutting edge 38. For convenience in description, and in the language used in the claims, the cutter member is described as moving in a corresponding vertical cutting plane 40 (FIGS. 2 and 3) passing through the cutting edge 38. A second fixed cutter bade 42 at the bottom ends of the grooves is fastened by screws to the top surface 22 with its cutting edge 44 in the cutting plane 40 and facing upward. The portions of the grooves 34 between the two cutter members are provided with safety stop members 46 which limit the downward movement of the cutter member 36 to that required to cut the brick 10, and so that the blade cannot accidently descend on to the hand of an operative if for any reason it should pass beneath the blade while handling the bricks. A U-shaped handle 47 is attached to one of the pillars 28 and serves as a carrying handle for the apparatus, which is sufficiently light to be carried by a single operative up ladders and on to elevated scaffolds.

The preferred cutting force applying means of the invention takes advantage of the brittle character of bricks, blocks, cut stone and the like, despite their relatively very high compression strengths, to cut quickly and accurately in the cutting plane by applying an energy-stored impact cutting force to the movable blade while it is in contact with the brick, this force being applied as strongly and as quickly as possible. The fast-acting impact force simultaneously hammers the brick downward into engagement with the fixed lower blade. In this embodiment such impact hammer means comprise a relatively long vertically extending shaft 48 connected by a saddle 50 to the upper edge of the cutter member 36, the shaft being supported by the cutter mounting means via a bushing 52 mounted in the cross member 30, through which the lower end of the shaft passes freely but with minimum play. The much longer upper end of the shaft is of smaller diameter than the lower end to provide a radially extending annular shoulder 54 at their junction close to the cross-member 30 that constitutes a solid anvil against which a cylindrical hand gripped hammer weight 56, mounted on the shaft for free, vertical sliding, guided movement, is crashed downward by the operator to produce the required fast acting impact cutting force. A collar 58 securely clamped to the shaft butts against the shoulder and is therefore impacted by the hammer and transmits the impact force to the shoulder, this collar serving as an anchor for a handle 60 by which the movable blade is moved upward from its lowermost position against the safety stops 46 for insertion of the brick 10 beneath it. The top end of the shaft ends in a removable head 61 that prevents disengagement of the hammer weight from the shaft.

The size of the weight 56 depends upon the size and hardness of the body intended to be cut and therefore is larger for apparatus intended to cut building blocks and stone, or if the bricks to be cut are hard fired and of dense "engineering" quality. At least a portion of the weight is of length and diameter such that it can be gripped easily by the hand of an operator, and it is provided at least at its lower end with a radially extending flange 62 to prevent slipping of the operator's hand as it is hammered downwards. A flange can also be provided at the upper end, if desired. The weight can be increased as desired by lengthening it and/or by increasing its diameter at one or both ends so that it assumes a dumbbell shape. Since the weight is captive on the shaft, and is always positively guided thereby into contact with the anvil, there is no danger even with a very heavy hammer that the operator will miss and damage the apparatus. An increase in effective cutting force can also be obtained by increasing the length of the reduced diameter upper end of the shaft 48 on which the weight moves, thus increasing the potential energy which is stored in the weight during its downward movement and which is released rapidly upon impact to increase the effectiveness of the cutting action upon the relatively brittle fired brick material. If desired different sizes of hammer weights can be provided for use with the same apparatus, and in an embodiment which is not illustrated the shaft may be provided with extensions that are added as and when needed.

The brick 10 to be cut is placed on a body receiving plate member 64, on the top surface 66 thereof, this member being disposed above and spaced from the base member 20 and being resiliently mounted for vertical movement toward and away from the base member parallel to the cutting plane. In this embodiment the resilient mounting consists of four headed machine screws 68 screw-threaded into the underside of the plate member adjacent respectively to its four corners, each being a free, close sliding fit in a respective bore in the base member. Each screw shaft is embraced by a respective compression coil spring 70 interposed between the base member top surface 22 and the plate member bottom surface, the springs urging the plate member upward to an uppermost position shown in FIG. 2, in which the screw heads but against the base member bottom surface. Such a resilient mounting means therefore permits relatively free vertical movement of the plate member relative to the base member, but constrains against transverse movement between them. In this position the bottom surface 14 of a standard brick placed on the plate member touches the bottom blade 44, ready for simultaneous cutting action by the two blades after the movable blade edge 38 has been moved into contact with the brick top surface 12. The end of the brick on the other side of the cutting plane 40 extends over a support member 72 mounted on the upper surface of the base member ready to receive the respective brick part when it is cut from the brick.

The cutting blades need penetrate only a short way into the brick before brittle fracture occurs along the cutting plane, and the resilient mounting of the brick supporting plate member 64 for this vertical movement permits adequate penetration of the lower blade, thereby markedly increasing the effectiveness of the impact cutting force, and resulting in clean accurate cuts since they are propagated equally from both top and bottom by the two parallel registering knife blades. As an example of the improved action obtained it is found that such cuts are obtained accurately at the chosen site, even when the bricks are of the type provided with vertical mortar receiving keying holes, which with some prior art apparatus, as described above, often fracture in a plane passing through the holes instead of in the desired cutting plane through a solid part of the brick. It is preferred to use resilient mounting means, such as that described and shown, that confines the plate member 64 to such vertical movement parallel to the cutting plane and the cutting force and constrains against transverse movement. Thus, in an embodiment (not shown) in which the compression springs 70 are replaced by a pad of a suitable resilient material the bolts 68 are retained to provide the desired transverse restraint.

Measuring means are provided for quickly setting the size of the brick portion to be cut, and to facilitate repetitive cuts of pieces of the same size, and these means comprise a rigid U-shaped measuring frame having two parallel side members 74 and a connecting end member 76, the frame being mounted for movement over the top surface 66 of the plate member 64 toward and away from the cutter plane 40. The side members are rods of circular cross-section which slide freely with minimum play in respective apertures in the vertical columns 28, while the end member is of square cross-section rigidly connected to them. The respective end surface 18 of the brick does not engage the end member 76, but instead engages the corresponding parallel vertical surface 78 of a stop member 80 resiliently mounted by the measuring frame for movement toward and away from the end member and the cutting plane. The distance of the surface 78 from the cutting plane, and the corresponding lengths of the cut brick parts, is set by selective engagement of a captive movable pin 82 that passes through a vertical hole 83 in the member 76 and in one of a row of uniformly spaced holes 84 in the plate member 64, the upper surface 66 of which is provided with a graduated scale to facilitate positioning of the frame thereon. In this embodiment the end portions of the side members 74 are reduced in diameter to provide respective annular shoulders 86 against which the stop member is pressed toward the cutting plane by compression coil springs 88 mounted around the reduced ends of the members 74 so as to be interposed between the stop and end members.

Figure 3:
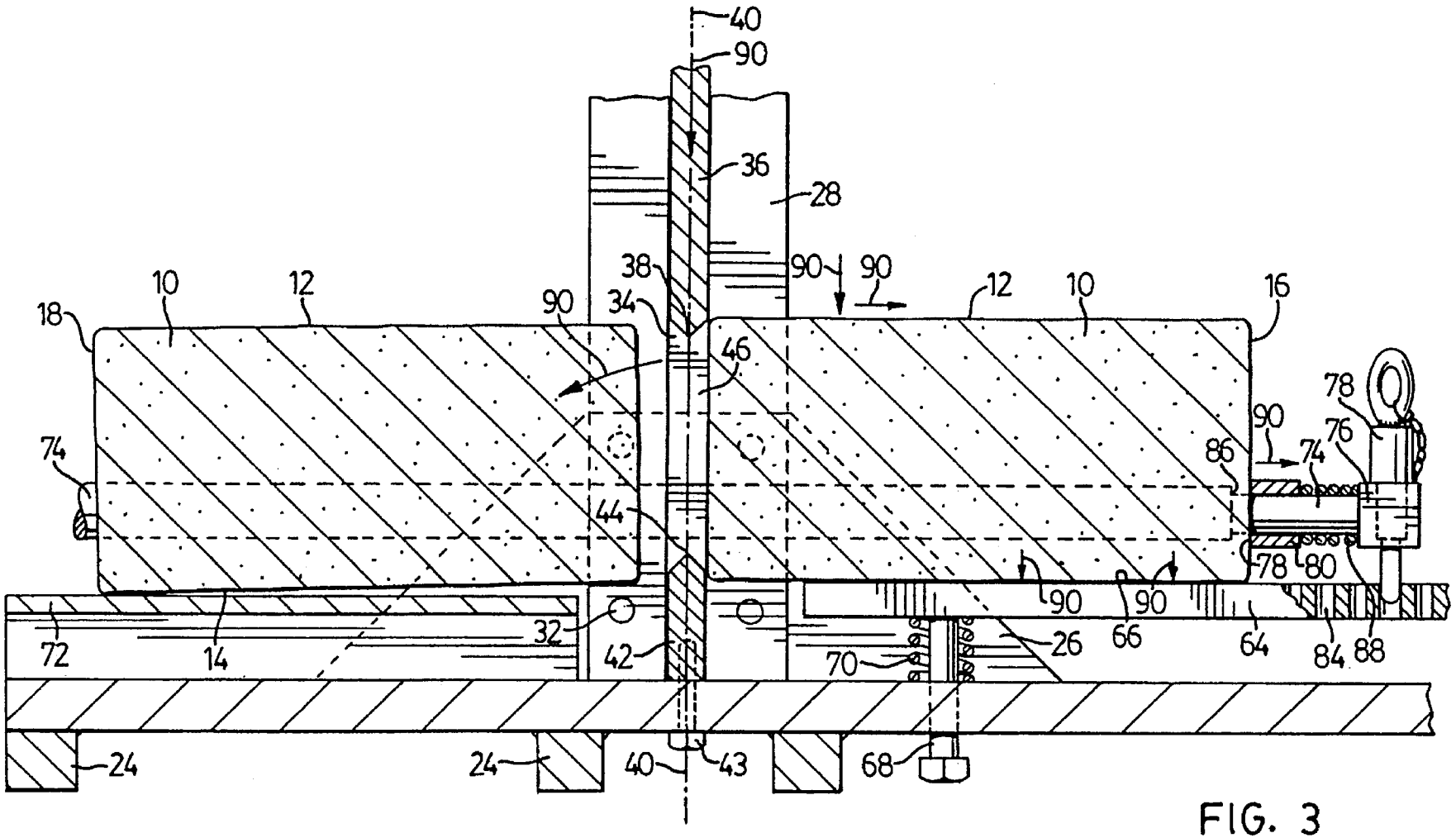

In operation the measuring frame is fixed by the pin 78 in the position in which, with the stop member 80 in contact with the shoulders 86, and with the end surface 16 of the brick in contact with the stop member surface 78, the cutting plane intersects the brick at the desired point. The movable blade is engaged with the brick upper surface and the hammer weight then lifted to the top of the shaft 48 and moved forcefully down against the anvil 54. The directions of movement of the movable cutter, the brick parts, and the resiliently mounted parts of the apparatus are indicated in FIG. 3 by the arrows 90, the Figure showing their various positions immediately after the cut has taken place. The resilient mounting of the stop member for movement away from the cutting plane permits corresponding movement of the part of the brick between the stop member and the cutter away from the cutter, under the wedging action of the cutter edges 38 and 44 as they enter the brick, surface 78 and shoulder 86 now being separated, and is found to facilitate the brittle fracture of the brick, without affecting the accurate prior measurement of the length of the parts into which the brick has been separated. The cutting is also facilitated by the cooperative resilient mounting of the plate member 64 for vertical movement as described above, enabling the lower cutter 42 to penetrate the brick the small distance required; as shown in FIG. 3 the springs 70 are now compressed. It is also found that relatively thin pieces, e.g. down to about 2.5 cm (1 in) thick can be cut cleanly and accurately, even when the cutting plane is close to a vertical hole in the brick.

It is believed apparent therefore that my invention provides a new self-contained guillotine cutting apparatus for solid bodies that is able to cut those of hard brittle materials, despite the high compressive strength of such materials, the apparatus being relatively lightweight in construction, so that it can readily be carried up ladders by a single operator and operated in restricted quarters, such as on building scaffolding. Its moving parts are relatively maintenance free, requiring only periodic replacement or regrinding of the cutters as they become worn. The ease and speed of operation in the field is such that its cost is quickly recovered both by reduced labour costs and by the considerable reduction in waste of material due to the avoidance of inaccurate cuts and excessive breakage.

I claim:

1. Guillotine cutting apparatus for solid bodies having top, bottom, side and end surfaces, the apparatus comprising:

a base member upon which a body to be cut is placed with its bottom surface on a top surface of the base member;

cutter mounting means extending above the base member top surface and mounting a movable cutter member for movement toward and away from the base member top surface in a cutting plane;

a movable cutter member mounted by the cutter mounting means for said movement in the cutting plane, the member having a cutting edge engagable with the top surface of a body when placed on the base member top surface;

cutting force applying means operatively connected with the movable cutter member to impart a cutting force thereto to cut the body; and body measuring means having a stop member movably mounted thereby, against which stop member the respective end surface of a body to be cut is butted;

the body measuring means being disposed above the base member top surface and mounted for movement toward and away from the cutting plane to change the relative lengths of the parts into which the body is cut;

the body measuring means and the stop member having resilient means between them permitting movement of the stop member and of the respective cut portion of the body away from the cutting plane as the movable cutter member cuts the body.

2. Apparatus as claimed in claim 1, wherein the body measuring means comprises a U-shaped frame having two parallel side members and a connecting cross member disposed parallel to the cutting plane, and the stop member extends between the side members between the cross member and the cutting plane; and wherein the resilient means between the frame and the stop member comprises compression springs that are compressed by movement of the body away from the cutting plane as it is cut.

3. Apparatus as claimed in claim 1, wherein the cutting force applying means comprises a shaft attached to and extending from the movable cutter member in the cutting plane, an anvil member on the shaft, and a hammer member mounted on the shaft for movement thereon by an operative toward and away from the anvil member, the hammer member being guided by the shaft for impact with the anvil member to impart a stored energy impact cutting force to the movable cutter member.

4. Apparatus as claimed in claim 1, and comprising a second cutter member mounted by the base member and having a cutting edge disposed in the cutting plane engagable with the bottom surface of a body to be cut when placed on the base member top surface;

whereby the cutting force applied to the movable cutter member forces the body into simultaneous cutting engagement with the cutting edge of the second cutter member.

5. Apparatus as claimed in claim 1, and comprising a body receiving member disposed to one side of the cutting plane and having top and bottom surfaces, the member being disposed above and spaced from the base member and receiving on its top surface a respective portion of a body to be cut; and resilient mounting means mounting the body receiving member on the base member and permitting corresponding movement of the body receiving member and the respective cut portion of the body toward the base member as the movable cutter member cuts the body.

6. Apparatus as claimed in claim 3, and comprising a second cutter member mounted by the base member and having a cutting edge disposed in the cutting plane engagable with the bottom surface of a body to be cut when placed on the base member top surface;

whereby the cutting force applied to the movable cutter member forces the body into simultaneous cutting engagement with the cutting edge of the second cutter member.

7. Apparatus as claimed in claim 3, and comprising a body receiving member disposed to one side of the cutting plane and having top and bottom surfaces, the member being disposed above and spaced from the base member and receiving on its top surface a respective portion of a body to be cut; and resilient mounting means mounting the body receiving member on the base member and permitting corresponding movement of the body receiving member and the respective cut portion of the body toward the base member as the movable cutter member cuts the body.

8. Apparatus as claimed in claim 4, and comprising a body receiving member disposed to one side of the cutting plane and having top and bottom surfaces, the member being disposed above and spaced from the base member and receiving on its top surface a respective portion of a body to be cut; and resilient mounting means mounting the body receiving member on the base member and permitting corresponding movement of the body receiving member and the respective cut portion of the body toward the base member as the movable cutter member cuts the body.

9. Apparatus as claimed in claim 6, and comprising a body receiving member disposed to one side of the cutting plane and having top and bottom surfaces, the member being disposed above and spaced from the base member and receiving on its top surface a respective portion of a body to be cut; and resilient mounting means mounting the body receiving member on the base member and permitting corresponding movement of the body receiving member and the respective cut portion of the body toward the base member as the movable cutter member cuts the body.

10. Apparatus as claimed in claim 3, wherein the body measuring means comprises a U-shaped frame having two parallel side members and a connecting cross member disposed parallel to the cutting plane, and the stop member extends between the side members between the cross member and the cutting plane; and wherein the resilient means between the frame and the stop member comprises compression springs that are compressed by movement of the body away from the cutting plane as it is cut.

11. Apparatus as claimed in claim 5, wherein the body measuring means comprises a U-shaped frame having two parallel side members and a connecting cross member disposed parallel to the cutting plane, and the stop member extends between the side members between the cross member and the cutting plane; and wherein the resilient means between the frame and the stop member comprises compression springs that are compressed by movement of the body away from the cutting plane as it is cut.

12. Guillotine cutting apparatus for solid bodies having top, bottom, side and end surfaces, the apparatus comprising:

a base member upon which a body to be cut is placed with its bottom surface on a top surface of the base member;

cutter mounting means extending above the base member top surface and mounting a movable cutter member for movement toward and away from the base member top surface in a cutting plane;

a movable cutter member mounted by the cutter mounting means for said movement in the cutting plane, the member having a cutting edge engagable with the top surface of a body when placed on the base member top surface; and cutting force applying means operatively connected with the movable cutter member to impart a cutting force thereto to cut the body;

wherein the cutting force applying means comprises a shaft attached to and extending from the movable cutter member in the cutting plane, an anvil member on the shaft, and a hammer member mounted on the shaft for movement thereon by an operative toward and away from the anvil member, the hammer member being guided by the shaft for impact with the anvil member to impart a stored energy impact cutting force to the movable cutter member.

13. Apparatus as claimed in claim 12, and comprising a second cutter member mounted by the base member and having a cutting edge disposed in the cutting plane engagable with the bottom surface of a body to be cut when placed on the base member top surface;

whereby the cutting force applied to the movable cutter member forces the body into simultaneous cutting engagement with the cutting edge of the second cutter member.

14. Apparatus as claimed in claim 12, and comprising a body receiving member disposed to one side of the cutting plane and having top and bottom surfaces, the member being disposed above and spaced from the base member and receiving on its top surface a respective portion of a body to be cut; and resilient mounting means mounting the body receiving member on the base member and permitting corresponding movement of the body receiving member and the respective cut portion of the body toward the base member as the movable cutter member cuts the body.

15. Apparatus as claimed in claim 13, and comprising a body receiving member disposed to one side of the cutting plane and having top and bottom surfaces, the member being disposed above and spaced from the base member and receiving on its top surface a respective portion of a body to be cut; and resilient mounting means mounting the body receiving member on the base member and permitting corresponding movement of the body receiving member and the respective cut portion of the body toward the base member as the movable cutter member cuts the body.

16. Apparatus as claimed in claim 12, wherein the shaft is cylindrical, has a portion of larger diameter attached to the cutter member, and has a portion of smaller diameter on which the hammer member moves, and wherein the anvil comprises a radially extending annular shoulder between the shaft portion of larger diameter and the shaft portion of smaller diameter.

17. Apparatus as claimed in claim 15, wherein the cutting force applying means shaft is cylindrical, has a portion of larger diameter attached to the cutter member, and has a portion of smaller diameter on which the hammer member moves, and wherein the anvil comprises a radially extending annular shoulder between the shaft portion of larger diameter and the shaft portion of smaller diameter.

18. Apparatus as claimed in claim 16, wherein the cutting force applying means shaft is cylindrical, has a portion of larger diameter attached to the cutter member, and has a portion of smaller diameter on which the hammer member moves, and wherein the anvil comprises a radially extending annular shoulder between the shaft portion of larger diameter and the shaft portion of smaller diameter.

19. Guillotine cutting apparatus for solid bodies having top, bottom, side and end surfaces, the apparatus comprising:

a base member upon which a body to be cut is placed with its bottom surface on a top surface of the base member;

cutter mounting means extending above the base member top surface and mounting a movable cutter member for movement toward and away from the base member top surface in a cutting plane;

a movable cutter member mounted by the cutter mounting means for said movement in the cutting plane, the member having a cutting edge engagable with the top surface of a body when placed on the base member top surface;

cutting force applying means operatively connected with the movable cutter member to impart a cutting force thereto to cut the body;

a second cutter member mounted by the base member and having a cutting edge disposed in the cutting plane engagable with the bottom surface of a body to be cut when placed on the base member top surface;

whereby the cutting force applied to the movable cutter member forces the body into simultaneous cutting engagement with the cutting edge of the second cutter member;

a body receiving member disposed to one side of the cutting plane and having top and bottom surfaces, the member being disposed above and spaced from the base member and receiving on its top surface a respective portion of a body to be cut; and resilient mounting means mounting the body receiving member on the base member and permitting corresponding movement of the body receiving member and the respective cut portion of the body toward the base member as the movable cutter member cuts the body.

20. Guillotine cutting apparatus for solid bodies having top, bottom, side and end surfaces, the apparatus comprising:

a base member upon which a body to be cut is placed with its bottom surface on a top surface of the base member;

cutter mounting means extending above the base member top surface and mounting a movable cutter member for movement toward and away from the base member top surface in a cutting plane;

a movable cutter member mounted by the cutter mounting means for said movement in the cutting plane, the member having a cutting edge engagable with the top surface of a body when placed on the base member top surface;

cutting force applying means operatively connected with the movable cutter member to impart a cutting force thereto to cut the body; and a body receiving member disposed to one side of the cutting plane and having top and bottom surfaces, the member being disposed above and spaced from the base member and receiving on its top surface a respective portion of a body to be cut; and resilient mounting means mounting the body receiving member on the base member and permitting corresponding movement of the body receiving member and the respective cut portion of the body toward the base member as the movable cutter member cuts the body.

* * * * *